US005318468A

United States Patent [19]

Lotthammer et al.

[11] Patent Number: 5,318,468

[45] Date of Patent: Jun. 7, 1994

[54] DISPENSER CATHODE AND PROCESS FOR PREPARING IT

[75] Inventors: Rolf Lotthammer, Dornstadt; Frank Bossert, Ulm; Manfred Hacker, Illerkirchenberg, all of Fed. Rep. of Germany

[73] Assignee: Licentia Patent-Verwaltungs-GmbH, Frankfurt am Main, Fed. Rep. of Germany

[21] Appl. No.: 873,370

[22] Filed: Apr. 24, 1992

[30] Foreign Application Priority Data

May 7, 1991 [DE] Fed. Rep. of Germany ..... 4114856

[51] Int. Cl.[5] ..... H01J 9/04

[52] U.S. Cl. ..... 445/50

[58] Field of Search ..... 445/50, 51; 313/346 R, 313/346 DC

[56] References Cited

U.S. PATENT DOCUMENTS

| | | | |
|---|---|---|---|
| 3,010,196 | 11/1961 | Smith et al. | 445/50 X |
| 3,373,307 | 3/1968 | Zalm et al. | 313/346 R |
| 3,842,309 | 10/1974 | Van Stratum et al. | 445/51 |
| 4,114,243 | 9/1978 | Soeno et al. | 445/50 X |
| 4,165,473 | 8/1979 | Falee | 313/346 DC |
| 4,279,784 | 7/1981 | Misumi et al. | 445/50 X |
| 4,417,173 | 11/1983 | Tuck et al. | 313/346 |
| 4,570,099 | 2/1986 | Green | 313/346 DC |
| 4,982,133 | 1/1991 | Choi | 313/346 |

FOREIGN PATENT DOCUMENTS

| | | | |
|---|---|---|---|
| 0019992 | 3/1980 | European Pat. Off. . | |
| 0178716 | 10/1985 | European Pat. Off. . | |
| 1068818 | 11/1959 | Fed. Rep. of Germany | 21/13 |
| 2048224 | 4/1972 | Fed. Rep. of Germany | 21/13 |
| 2947919 | 11/1979 | Fed. Rep. of Germany . | |
| 3122950 | 6/1981 | Fed. Rep. of Germany . | |
| 3708687 | 3/1987 | Fed. Rep. of Germany . | |
| 680670 | 10/1975 | U.S.S.R. . | |
| 890479 | 3/1990 | U.S.S.R. . | |

*Primary Examiner*—Kenneth J. Ramsey
*Attorney, Agent, or Firm*—McGlew and Tuttle

[57] ABSTRACT

A dispenser cathode with multilayer sintered body is suggested, wherein the layers have a thickness of between 0.01 and 10 mm and have different compositions.

32 Claims, 1 Drawing Sheet

DISPENSER CATHODE AND PROCESS FOR PREPARING IT

FIELD OF THE INVENTION

The present invention pertains to a dispenser cathode and more particularly to a dispenser cathode with a porous dispensing body which contains at least two metals of a first group such as W, Mo, Cr and/or a second group such a Ni, Ru, Rh, Pd, Re, Os, Ir, Pt, Sc, Y, La, lanthanides, Ti, Zr, Hf, Nb, and Ta, and is impregnated with an emission material which contains at least two alkaline earth metal oxides, such as CaO or BaO, and at least one oxide of a metal group IIIa or IIIb on a periodic chart, e.g., $Al_2O_3$.

BACKGROUND OF THE INVENTION

Dispenser cathodes are also called matrix cathodes. They consist, in general, of a dispensing body, which is pressed or sintered from a metal powder and is impregnated with the actual emission material. Metals such as tungsten, molybdenum, or chromium can be considered for use as the metal powder for the dispensing body. The use of mixtures of such metal powders has been known as well. It has been known from, e.g., German Auslegeschrift No. DE-AS 10,68,818 that the dispensing body can be built up in a layered pattern. It has been known from German Offenlegungsschrift No. DE-OS 20,48,224 that dispensing bodies can be pressed into a cavity of a cathode sleeve. The porous matrix body can be impregnated with an emission material, which consists of, e.g., $BaO-CaO-Al_2O_3$, by impregnation, melting in, or the like.

It has been found, in general, that so-called mixed metal cathodes, i.e., cathodes whose dispensing bodies are pressed and sintered from a metal powder mixture, posses improved emission properties and better current stability. The dispensing bodies of mixed metal cathodes consist, in general, of metals of a first group, such as tungsten, molybdenum, or chromium, and of metals of a second group, such as nickel (Ni), ruthenium (Ru), rhodium (Rh), palladium (Pd), rhenium (Re), osmium (Os), iridium (Ir), platinum (Pt), scandium (Sc), yttrium (Y), lanthanum (La), lanthanides, titanium (Ti), zirconium (Zr), hafnium (Hf), niobium (Nb), and tantalum (Ta). A higher percentage of metals of the second group, especially a higher percentage of Os, was found to have a highly favorable effect on the stability of the emission current. However, shrinkage of the sintered body, as a result of which poor heat transmission to the cathode sleeve and undesirable evaporation of the emission material occur, was found to be disadvantageous.

SUMMARY AND OBJECTS OF THE INVENTION

It is a primary object of the present invention to provide a novel mixed metal dispenser cathode which contains a higher content of a metal of the second group, especially osmium, at least in the area of the emitting surface, and in which the aforementioned disturbing phenomena are extensively reduced. Providing a process for preparing such a mixed metal dispenser cathode is considered to be another task of the present invention.

According to the invention, a dispenser cathode is provided with a porous dispensing body. The dispensing body comprises a first and a second powder-pressed and preferably sintered, porous layer, the second layer located on top of the first layer. The first layer and the second layer comprise different compositions and contain at least two metals of a first group such as W, Mo, Cr and/or a second group such as Ni, Ru, Rh, Pd, Re, Os, Ir, Pt, Sc, Y, La, lanthanides, Ti, Zr, Hf, Nb, and Ta. The two metals are impregnated with an emission material which contains at least two alkaline earth metals such as CaO or BaO, and at least one oxide of a metal of group IIIa or IIIb or the periodic chart, e.g., $Al_2O_3$. The two layers are firmly connected to one another and have a thickness of between 0.01 mm and 10 mm each. Preferably, the two layers consist essentially of the same metals but the content of a metal of the second group is higher in the second layer than in the first layer.

The invention also includes a process for preparing a dispenser cathode including a first and second powder-pressed and preferably sintered, porous layer each layer being formed of two metals of a first group such as W, Mo, Cr and/or a second group such as Ni, Ru, Rh, Pd, Re, Os, Ir, Pt, Sc, Y, La, lanthanides, Ti, Zr, Hf, Nb and Ta. The two metals from the first and second group are preferably impregnated with an emission material which contains at least two alkaline earth metal oxides, such as CaO or BaO, and at least one oxide of a metal group IIIa or IIIb of the period chart, e.g. $Al_2O_3$. One of the layers is located on top of the other (the second layer on top of the first) and the layers are firmly connected to one another. The layers preferably have a thickness of between 0.01 mm and 10 mm each. The first layer is prepared preferably by slightly pressing the metal powder mixture forming the first layer. The metal powder mixture forming the second layer is subsequently applied to the free surface of the first layer. The second layer is formed by intensely pressing, so that it will interconnect with the first layer. The two-layer pressed body is subsequently sintered at an elevated temperature. The two-layer porous sintered body is then impregnated with the emission material. The free surface of the second layer is subsequently made into an emission surface e.g. by shaping.

The dispenser cathode may be formed by an alternate process including forming the first layer and slightly pressing the metal powder mixture forming the first layer. Subsequently, the metal powder mixture forming the second layer is applied to the free surface of the first layer. The second layer is formed, preferably by slightly pressing, so that the second layer will interconnect with the first layer. Metal powder mixture for a third layer, which has a higher content of a metal powder of the first group, such as W, Mo, or Cr, than the metal powder mixture of the second layer, is subsequently applied to a free surface of the second layer. A three-layer pressed body is then formed under high pressure. This pressed body is subsequently sintered at high temperatures. The porous three-layer sintered body is subsequently impregnated with the emission material and the third layer is then removed mechanically. The emission surface is subsequently formed as a free surface of the second layer.

One essential advantage of the mixed metal dispenser cathode described is the fact that it has a dispensing body which has a high content of one or more than one metal of the second group, especially osmium. High porosity and low shrinkage are thus achieved. Dispenser cathodes with highly stable long-term behavior are thus obtained.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DETAILED DESCRIPTION OF THE PREFERRED EMBODIMENT

Figure 1B:
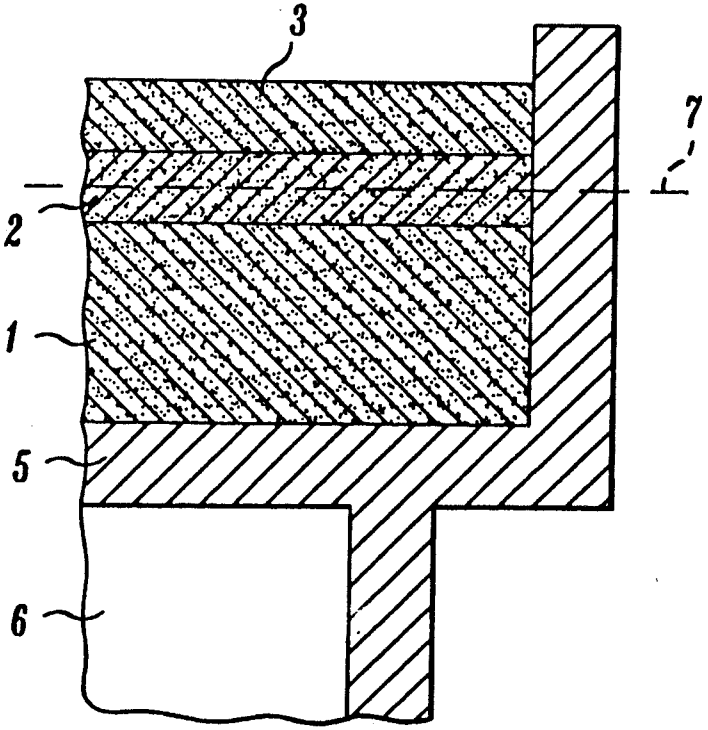
FIG. 1B is a cathode in an intermediate process step of a preferred preparation process.
Figure 1A:
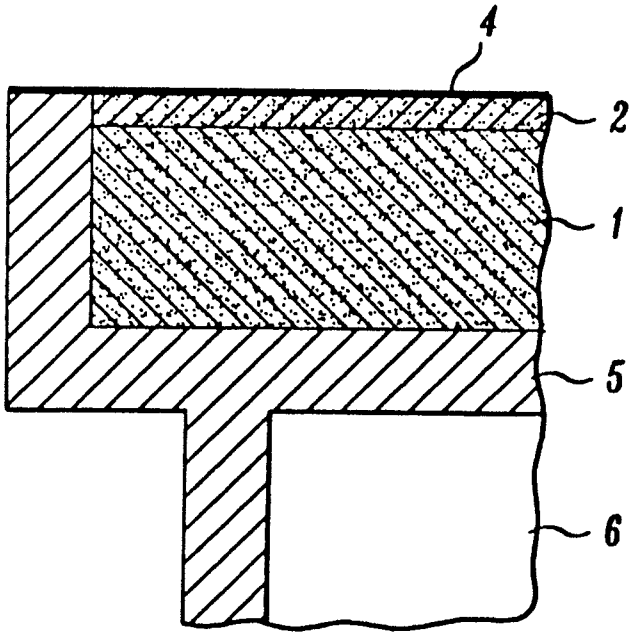
FIG. 1A is a multilayer dispenser cathode according to the present invention, which was prepared in the emission range.

The cross section shows a detail of a dispenser cathode with the cathode support 5 made of a high-melting metal, e.g., molybdenum, which is also called cathode sleeve, and has a cavity 6 for an electric heating element and a pot-shaped cavity for the multilayer dispensing body 1, 2. The dispensing body, which consists of the two porous, pressed and sintered mixed metal layers 1 and 2, which are connected to one another, is impregnated with an emission material, which consists essentially of oxides of the alkaline earth metals (BaO and CaO) and additionally contains at least one oxide of a metal of Group IIIa or IIIb of the Periodic Chart, e.g., aluminum oxide. The said dispenser cathode 1, 2 is connected to the wall of the pot-shaped part of the said cathode sleeve 5 by pressing and sintering such that good thermal conduction is achieved. The free surface 4 of the layer 2 forms the electron-emitting emission surface of the cathode. It may be made flat, curved, or into another shape by shaping.

The sintered body forming the first layer 1 consists, just as that of the second layer 2, of a mixture of metals of a first group, such as W, Mo, Cr, and metals of a second group, such as Ni, Ru, Rh, Pd, Re, Os, Ir, Pt, Sc, Y, La or lanthanides, Ti, Zr, Hf, Nb, or Ta. However, the two layers 1 and 2 are different in terms of the composition, especially in terms of the proportions of the components; the first layer 1 contains a higher percentage of a metal of the first group (Mo, W, Cr) than does the second layer 2. Correspondingly, the percentage of the metal of the second group (Ni, Ru, Rh, Pd, Re, Os, Ir, Pt, Sc, Y, La, Ti, Zr, Hf, Nb, Ta) is higher in the second layer 2 than in the first layer 1. Tungsten is a preferred metal of the first group. Osmium is a preferred metal of the second group. The first layer 1 is preferably thicker than the second layer 2. However, the thickness of both of said layers 1 and 2 is at least 0.01 mm. A preferred thickness of the first layer 1 is 0.1 to 10 mm, and especially ca. 1 mm. A preferred thickness of the second layer 2 is 0.01 to 1 mm, and especially ca. 0.05 to 0.5 mm.

In a preferred exemplary embodiment, the thickness of the first layer 1 was ca. 0.9 mm, and that of the second layer 2 was ca. 0.3 mm.

The composition of the first layer 1 is preferably 50 to 100 wt. % metal of the first group, especially W, the remainder being a metal of the second layer 2, especially Os. The composition of the second layer 2 is preferably 30 wt. % to 100 wt. % metal of the second group, especially Os, the remainder being a metal of the first group, especially W.

In one exemplary embodiment, the thickness of the first layer 1 was 0.9 mm, and it consisted of 80 wt. % tungsten and 20 wt. % osmium. The thickness of the second layer 2 was 0.3 mm, and it consisted of 50 wt. % W and 50 wt. % Os.

Two preferred preparation processes; a two-layer process and a three-layer process, will be described below. The latter process proved to be particularly advantageous when the second layer is to have a higher content of a metal of the second group (e.g., osmium) or compounds of these metals. The third sintered layer additionally applied in the three-layer process has, among other things, the task of forming a protective layer for the second layer during sintering and to make it possible to better control the shrinkage of the second layer with its high content of metal of the second group during sintering. It is subsequently removed.

Essentially the following process steps are carried out in the two-layer process:

1. filling the metal powder mixture for the first layer 1 into the pot-shaped cavity of the cathode sleeve 5,
2. leveling or shaping and, if desired, slightly pressing the powder mixture filled in,
3. filling the metal powder mixture for the second layer 2 onto the layer 1,
4. leveling or shaping and pressing under high pressure, e.g., 10 kN,
5. sintering at a high temperature of between 1800° C. and 2200° C.,
6. impregnating the sintered dispensing body with emission material, e.g., by immersing, melting in, or the like,
7. shaping the emission surface 4 of the said second layer 2, e.g., by mechanical treatment.

If a preferred three-layer process is carried out, the above-described two-layer process is advantageously modified after process step 3 as follows:

4. leveling or shaping and, if desired, slightly pressing the powder mixture filled in for the second layer 2,
5. filling in the powder mixture for the third layer 3,
6. leveling or shaping and pressing of all three powder mixtures filled in under a high pressure, e.g., 10 kN,
7. sintering at elevated temperature, e.g., between 1800° C. and 2200° C.,
8. impregnating the sintered three-layer body with emission material, e.g., by immersing, melting, or the like,
9. removing the third layer 3 and, if desired, the edge of the said cathode sleeve, e.g., by mechanical treatment,
10. shaping the emission surface 4 of the said second layer 2, e.g., by mechanical treatment.

Powder mixtures of the following composition are preferably used.

A metal powder mixture consisting essentially of 50 wt. % to 100 wt. % tungsten, the remainder being osmium, for the first layer 1. A metal powder mixture consisting essentially of 30 wt. % to 100 wt. % osmium, the remainder being tungsten, for the second layer 2.

A metal powder mixture consisting essentially of 50 wt. % to 100 wt. % tungsten, the remainder being osmium, for the third layer 3.

The same composition is advantageously selected for the first layer 1 and the third layer 3. The use of a said third layer 3 proved to be advantageous in the case of dispensing bodies with high osmium content, e.g., >50 wt. %, in the second layer 2. It may also be advantageous to add a neutral filler, e.g., emission material, in the case of high osmium content to increase porosity.

While specific embodiments of the invention have been shown and described in detail to illustrate the application of the principles of the invention, it will be understood that the invention may be embodied otherwise without departing from such principles.

What is claimed is:

1. A process for preparing a dispenser cathode, the process comprising the steps of: preparing a first dispenser cathode layer by slightly pressing a metal powder mixture comprising at least two metals one of which is selected from a first group including W, Mo, Cr, and one of which is selected from a second group Ni, Ru, Rh, Pd, Re, Os, Ir, Pt, Sc, Y, La, Lanthanides, Ti, Zr, Hf, Nb, and Ta; forming a second layer of a metal powder mixture comprising the same two metals of said first dispenser cathode layer, said metal powder mixture of said second layer being different from said metal powder mixture of said first layer with a percentage of the metal from said first group being higher in said second layer than in said first layer and applying the metal powder mixture forming the second layer to a free surface of said first layer, said second layer being formed to be thinner than said first dispenser cathode layer; intensely pressing said second layer to interconnect said second layer with said first layer to form an interconnected two-layer pressed body; subsequently sintering said two-layer pressed body at elevated temperature to form a two-layered porous sintered body; impregnating said two-layer porous sintered body with an emission material containing at least two alkaline earth metal oxides, such as CaO or BaO, and at least one oxide of a metal of group IIIa or IIIb of the periodic chart, e.g., $Al_2O_3$; and shaping the free surface of said second layer to form an emission surface.

2. A process according to claim 1, wherein said impregnated multilayered cathode body is formed in a pot-shape cavity of a metallic cathode part, a part of an edge of said pot-shaped cathode part forming said cavity is removed during a formation of said emission surface.

3. A process according to claim 1, wherein sintering is carried out at temperatures of 1500°-2200° C.

4. A process according to claim 3, wherein said sintering is carried out at temperatures of 1800°-2000° C.

5. A process according to claim 1, wherein said first layer is prepared with a thickness of 0.1 mm to 10 mm.

6. A process according to claim 5, wherein said first layer is prepared with a thickness of 0.5 mm to 1.5 mm.

7. A process according to claim 1, wherein said second layer is prepared with a thickness of 0.01 mm to 1 mm.

8. A process according to claim 7, wherein said second layer is prepared with a thickness of 0.05 mm to 0.5 mm.

9. A process according to claim 1, wherein a third layer is provided with a thickness of 0.01 mm to 1 mm.

10. A process according to claim 9, wherein said third layer is provided with a thickness of 0.05 mm to 0.5 mm.

11. A process according to claim 1, wherein a third layer is provided on top of said second layer, said first layer and third layer are prepared from a metal powder mixture containing 50 to 100 wt. % of a metal of said first group, the remainder being a metal of said second group.

12. A process according to claim 11, wherein said first layer and said third layer are prepared from a metal powder mixture containing approximately 80 wt. % of a W, the remainder being Os.

13. A process according to claim 1, wherein second layer is prepared from a metal powder mixture containing 30 to 100 qt. % of a metal of said second group, the remainder being a metal of said first group.

14. A process according to claim 13, wherein said metal powder mixture contains approximately 50 wt. % of Os., the remainder being of metal of said first group.

15. a process according to claim 1, wherein:

each of said first layer and second layer consist essentially of the same metals, a content of a metal of said second group is higher in said second layer than in said first layer.

16. A process according to claim 1, wherein:

a content of a metal of said first group is higher in said first layer than in said second layer.

17. A process according to claim 1, wherein:

a content of a metal of said first group is said first layer is higher than 20 wt. %.

18. A process for preparing a dispenser cathode, the process comprising: forming a first layer of metal powder mixture containing at least two metals, one of which is selected from a first group including W, Mo, Cr and one of which is selected from a second group Ni, Ru, Rh, Pd, Re, Os, Ir, Pt, Sc, Y, La, Lanthanides, Ti, Zr, Hf, Nb, and Ta, said metal powder mixture being slightly pressed; forming a second layer of a metal powder mixture, said second layer metal powder mixture being formed of at least two metals selected, one of which is from said first group and one of which is selected from said second group, said second layer metal powder mixture being different from said first layer metal powder mixture; applying said second layer metal powder mixture to a free surface of said first layer and forming said second layer by slightly pressing so said first layer will interconnect with said second layer; providing a metal powder mixture of a third layer, said metal powder mixture of said third layer being formed of at least two metals, one of which is selected from said first group and one of which is selected from said second group, said metal powder mixture of said third layer having a higher content of a metal powder of said first group than said metal powder mixture of said second layer, subsequently applying said third layer metal powder mixture to a free surface of said second layer and applying high pressure to from a three-layer pressed body; subsequently sintering said three-layer pressed body at high temperature to form a porous three-layer sintered body; subsequently impregnating said porous three-layer sintered body with an emission material containing at least two alkaline earth metal oxides and at least one oxide of a metal of group IIIa or IIIb of the periodic chart to form an impregnated multilayered cathode body; mechanically removing said third layer from said impregnated multilayer cathode body; and subsequently forming an emission surface as a free surface of said second layer.

19. A process according to claim 18, wherein said impregnated multilayer cathode body is prepared in a pot-shaped cavity of a metallic cathode part and an edge of said post-shaped cathode part forming said cavity is removed during the formation of said emission surface.

20. A process according to claim 18, wherein said sintering is carried out at temperatures of 100°-2200° C.

21. A process to claim 20, wherein said sintering is carried out at temperatures of 1800°-2000° C.

22. A process according to claim 18, wherein said first layer is prepared with a thickness of 0.1 mm to 10 mm.

23. A process according to claim 22, wherein said first layer is prepared with a thickness of 0.5 mm to 1.5 mm.

24. A process according to claim 18, wherein said second layer is prepared with a thickness of 0.01 mm to 1 mm.

25. A process according to claim 24, wherein said second layer is prepared with a thickness of 0.05 mm to 0.5 mm.

26. A process according to claim 18, wherein said third layer is prepared with a thickness of 0.01 mm to 1 mm.

27. A process according to claim 26, wherein said third layer is prepared with a thickness of 0.05 mm to 0.5 mm.

28. A process according to claim 18, wherein said first layer and said third layer are prepared from a metal powder mixture containing 50 to 100 wt. % of a metal of said first group, the remainder being a metal of said second group.

29. A process according to claim 28, wherein said third layer is prepared from a metal powder mixture containing 80 wt. % of W, the remainder being Os.

30. A process according to claim 18, wherein said second layer is prepared from a metal powder mixture containing 30 to 100 wt. % of a metal of said second group, the remainder being a metal of said first group.

31. A process according to claim 30, wherein said second layer is prepared from a metal mixture containing 50 wt. % of Os., the remainder being a metal of said first group.

32. A process according to claim 18, wherein said metal powder mixture of said second layer is different from said metal powder mixture of said first layer with a percentage of the metal from the first group being higher in said second layer than in said first layer, said second layer being formed to be thinner than said first layer.

* * * * *

UNITED STATES PATENT AND TRADEMARK OFFICE

CERTIFICATE OF CORRECTION

PATENT NO. : 5,318,468

DATED : June 7, 1994

INVENTOR(S) : Lotthammer et al

It is certified that error appears in the above-indentified patent and that said Letters Patent is hereby corrected as shown below:

On the title page, item [75], change "Illerkirchenberg" to --Illerkirchberg--.

Signed and Sealed this

Fourth Day of October, 1994

*Attest:*

*Attesting Officer*

BRUCE LEHMAN

*Commissioner of Patents and Trademarks*